United States Patent [19]

Lee

[11] Patent Number: 5,026,307

[45] Date of Patent: Jun. 25, 1991

[54] BATTERY TERMINAL CLAMP

[76] Inventor: Kuo-Shu Lee, 7F, 16, Alley 3, Lane 227, Nung-An Street, Taipei, Taiwan

[21] Appl. No.: 631,645

[22] Filed: Dec. 21, 1990

[51] Int. Cl.[5] ..... H01R 4/30

[52] U.S. Cl. ..... 439/755; 439/174; 439/504

[58] Field of Search ..... 439/172, 171, 174, 504, 439/755, 758, 765

[56] References Cited

U.S. PATENT DOCUMENTS

| | | | |
|---|---|---|---|
| 4,345,807 | 8/1982 | Shekel et al. | 439/755 |
| 4,377,317 | 3/1983 | Shekel et al. | 439/755 |
| 4,565,414 | 1/1986 | French | 439/755 |
| 4,620,767 | 11/1986 | Woolf | 439/755 |
| 4,923,415 | 5/1990 | Lee | 439/755 |
| 4,975,089 | 12/1990 | Lee | 439/755 |

*Primary Examiner*—Paula A. Bradley

*Attorney, Agent, or Firm*—Ladas & Parry

[57] ABSTRACT

A battery terminal clamp of the type comprising a conductive sliding clip movably secured to a terminal clamp at one side by a screw for clamping on a side mounted battery terminal of a car battery. The conductive sliding clip is stopped from moving backward by a side projection made on the terminal clamp when it is pushed out to a clamping position. Two opposite side edges are bent inwards through 90° angle to firmly attach to the two opposite side walls of the terminal clamp so as to protect the conductive sliding clip against torsional force.

3 Claims, 6 Drawing Sheets

BATTERY TERMINAL CLAMP

BACKGROUND OF THE INVENTION

The present invention relates to U.S. Pat. Nos. 4,923,415 and 4,975,089. In the present specification, there is disclosed a battery terminal clamp which has a sliding clip movably secured at one side of a conventional terminal clamp and retained in a working position by a screw for clamping on a side mounted battery terminal.

Battery failure has been known as one of the most common reasons which cause a motor vehicle to be unable to start. Under emergency conditions, jumper cable is commonly used to connect the car battery in trouble to the car battery of other car. A jumper cable is generally comprised of two battery terminal clamps connected through a cable. However, conventional battery terminal clamps are not suitable for use to clamp on the side mounted battery terminal of the battery which is set in the engine compartment of a motor vehicle.

SUMMARY OF THE INVENTION

The present invention has been accomplished to eliminate the aforesaid problem. According to the present invention, there is provided a battery terminal clamp having a sliding clip movably secured in a conventional terminal clamp at one side, which sliding clip can be moved back in a received position or pushed out and then fixed by a screw at a clamping position for clamping on the side mounted terminal of a car battery.

DETAILED DESCRIPTION OF THE PREFERRED EMBODIMENTS

Referring to FIGS. 1 through 4, the present invention is generally comprised of a conventional terminal clamp 1, and a sliding clip 2 secured to said terminal clamp 1 at one side by a screw 3.

Figure 5:
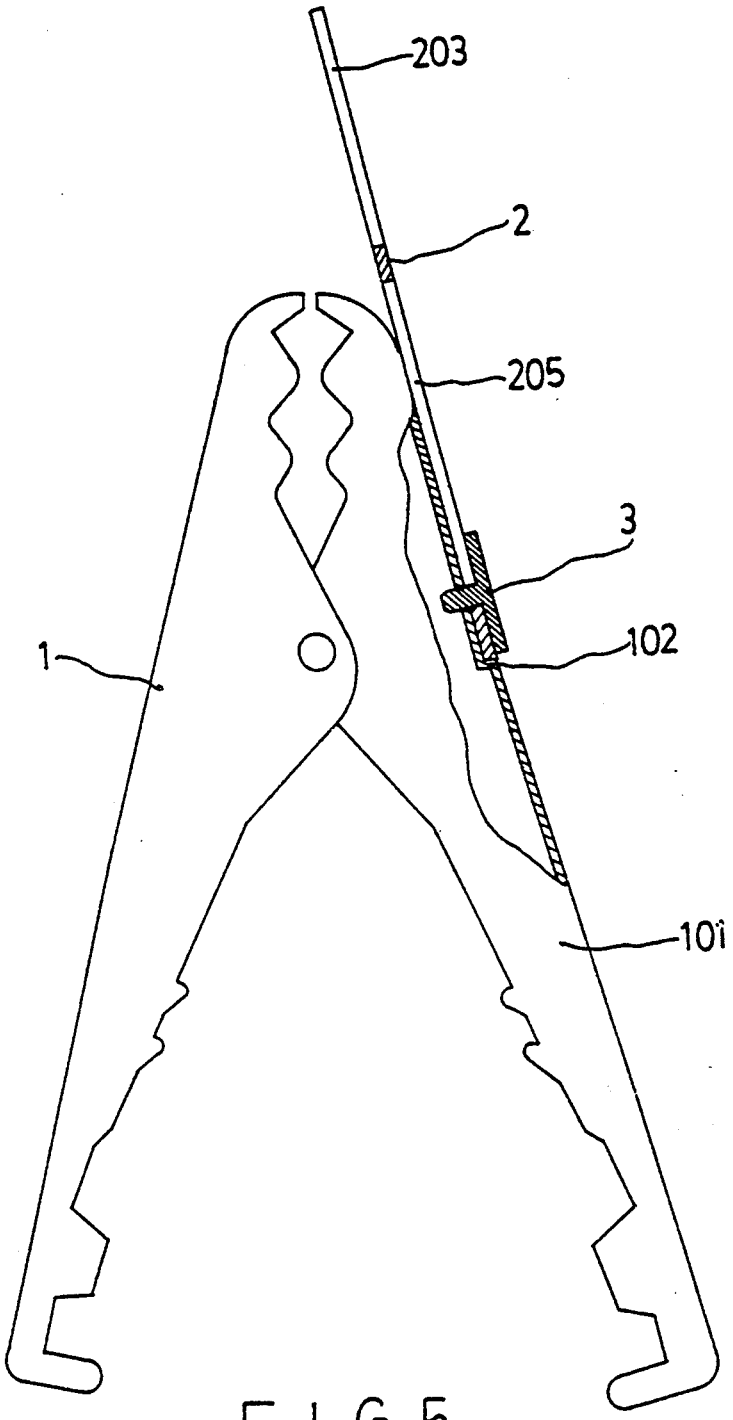
FIG. 5 is a side view of the present invention wherein the sliding clip is pushed into a clamping position.
Figure 6:
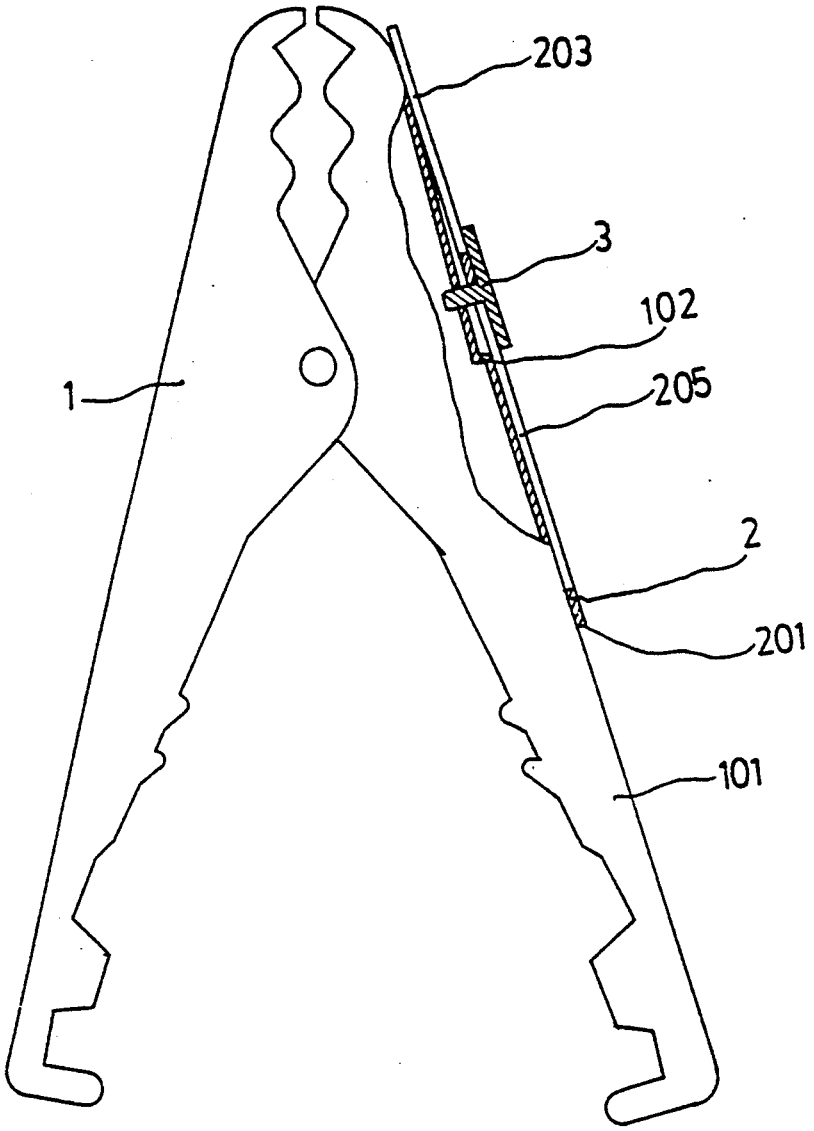
FIG. 6 is another side view of the present invention wherein the sliding clip is disposed at a received position.

As illustrated, the sliding clip 2 is secured to the clamping element 101 of the terminal clamp 1 at the outer side by the screw 3. Loosening the screw 3 permits the sliding clip 2 to be pushed to project over the top edge of the terminal clamp 1 into a clamping position. The clamping element 101 has a side projection 102 for stopping the bottom edge 201 of the sliding clip 2 when the sliding clip 2 is moved into a clamping position, so as to stop the sliding clip 2 from moving backward (see FIG. 5). As soon as the sliding clip 2 is moved into a clamping position, the screw 3 is fastened up again to fixedly secure the sliding clip 2 in position. When not in use, the sliding clip 2 can be moved back to closely attach to the clamping element 101 and fixedly secured thereto by the screw 3 (see FIG. 6).

Referring to FIGS. 1 and 2 again, the sliding clip 2 has an opening 203 at the front end thereof for retaining a battery terminal, a closed, elongated sliding slot 205 longitudinally disposed at a lower end through which the screw 3 is inserted to secure the sliding clip 2 to the clamping element 101 of the terminal clamp 1 permitting the sliding clip 2 to slide in longitudinal direction on the clamping element 101, and two opposite edges 206 at two opposite sides which are bent downward through 90° angle for retaining the two opposite side walls of the clamping element 101. By means of the effect of the two opposite edges 206, the sliding clip 2 is permitted to slide in longitudinal direction on the clamping element 101 and protected against torsional force.

Figure 1:
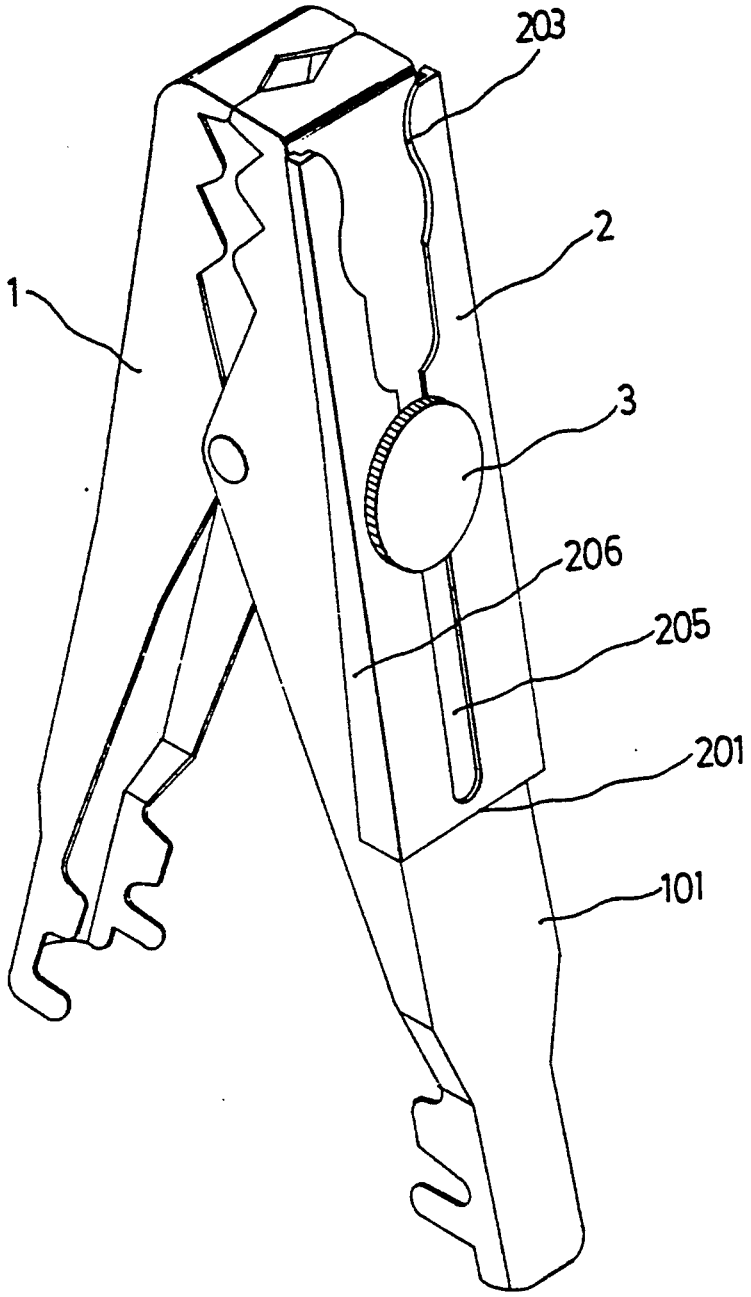
FIG. 1 illustrates a battery terminal clamp embodying the present invention wherein the sliding clip is disposed at a received position.
Figure 2:
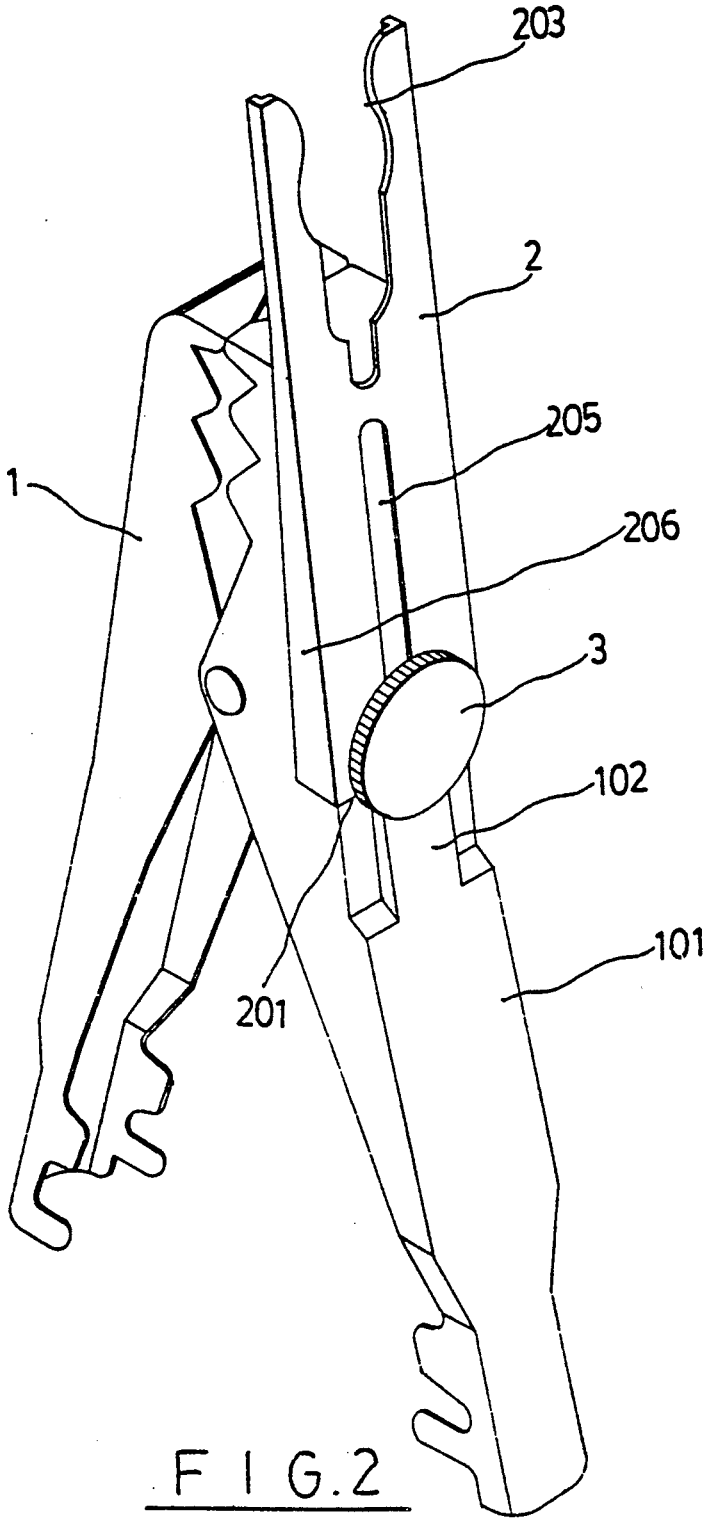
FIG. 2 illustrates the embodiment of FIG. 1 wherein the sliding clip is pushed into a clamping position.
Figure 3:
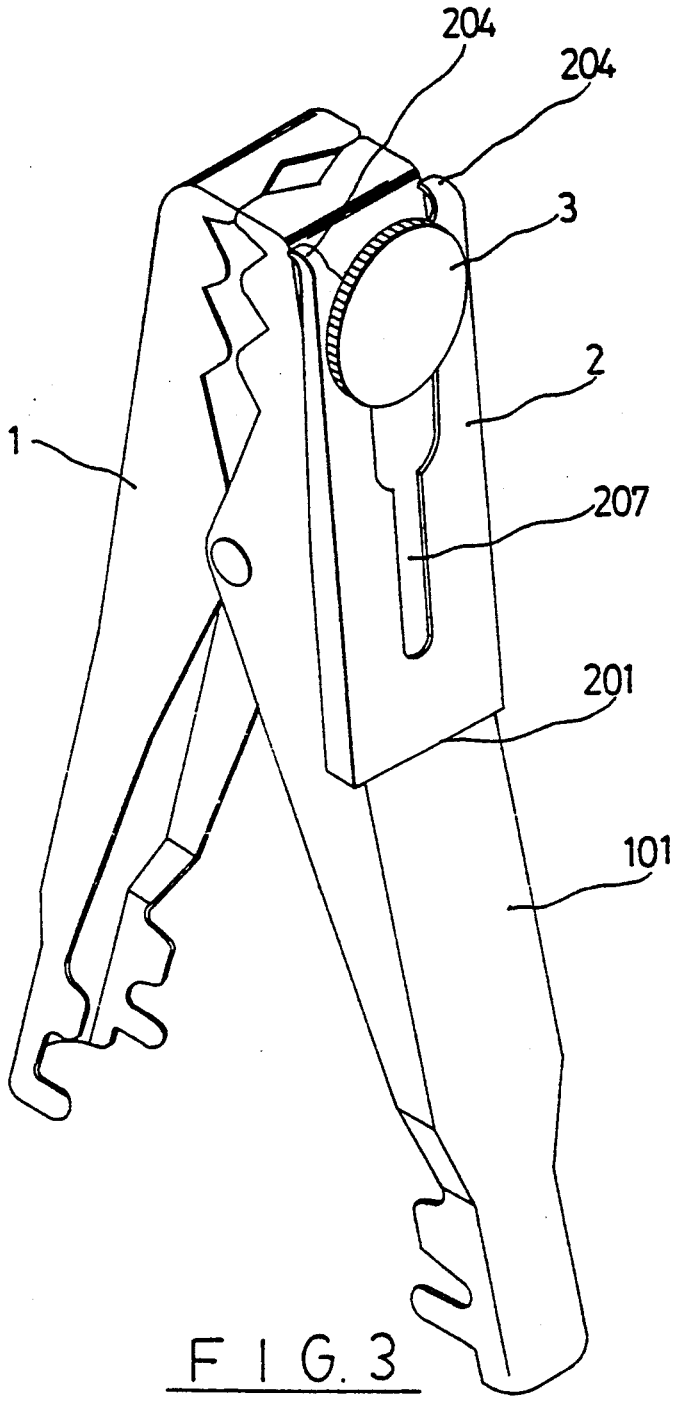
FIG. 3 illustrates an alternate form of the present invention wherein the sliding clip is disposed at a received position.
Figure 4:
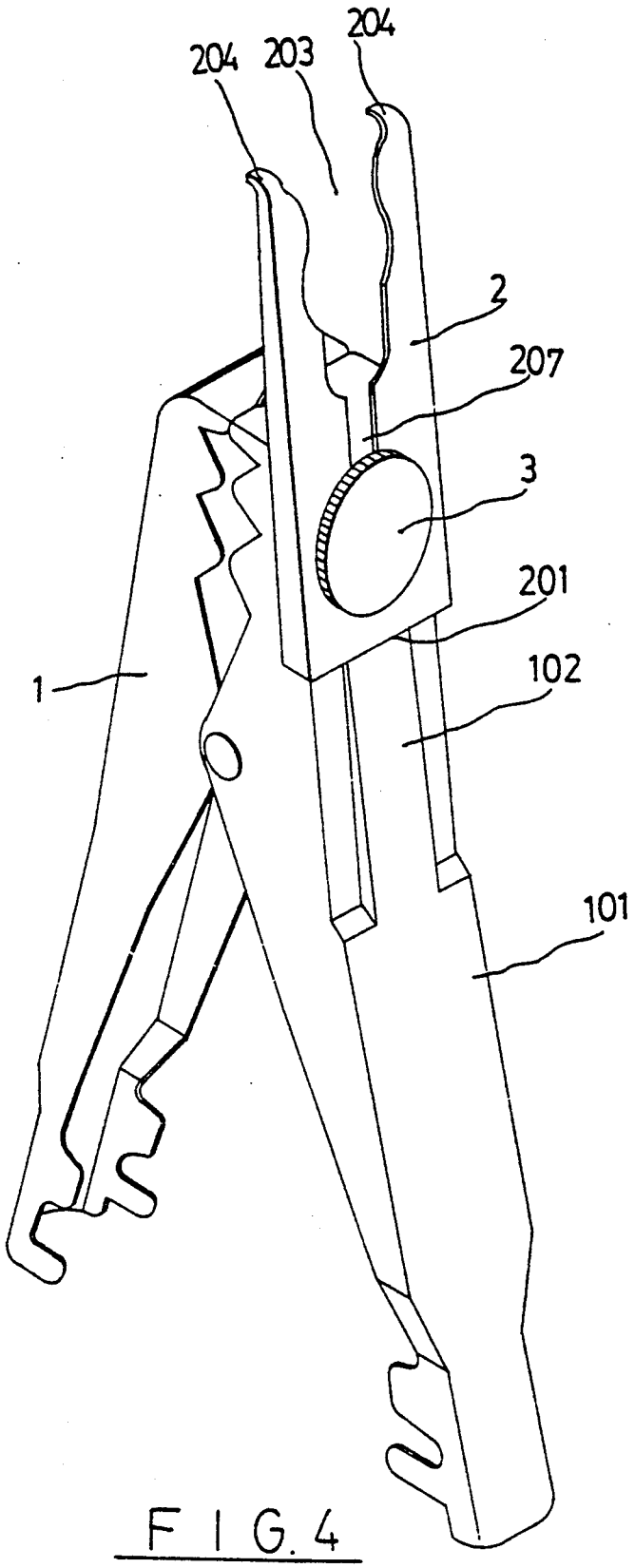
FIG. 4 illustrates the embodiment of FIG. 3 wherein the sliding clip is pushed into a clamping position.

Referring to FIGS. 3 and 4, there is illustrated an alternate form of the sliding clip 2. In this embodiment, the sliding clip 2 has an opening 203 at the front end thereof for retaining a battery terminal, an elongated sliding slot 207 extending downward from said opening 203, and two opposite hooked portions 204 bilaterally disposed at the front end thereof. When the sliding clip 2 is moved back into a received position, the two opposite hooked portions 204 are respectively engaged in the front end of the clamping element 101 so that the sliding clip 2 will not drop from the clamping element 101 after it is secured in position by a screw 3. Similar to the aforesaid first embodiment, the two opposite sides of the sliding clip 2 are respectively bent downward through 90° angle to firmly retain the two opposite side walls of the clamping element 101 against torsional force.

I claim:

1. A battery terminal clamp of the type comprising a conductive sliding clip movably secured to a terminal clamp at one side by a screw, wherein said conductive sliding clip has an opening at the front end thereof for retaining a battery terminal, an elongated sliding slot longitudinally disposed at a lower end through which said screw is inserted to secure said sliding clip to said terminal clamp, and two opposite edges at two opposite sides respectively bent downward through 90° angle to retain said terminal clamp at two opposite sides and protect said sliding clip against torsional force, and wherein said sliding clip can be pushed out to protrude beyond the top edge of said terminal clamp and stopped, at a clamping position for clamping on a battery terminal, by a side projection made on said terminal clamp at one side.

2. The battery terminal clamp of claim 1, wherein said sliding clip further comprises two opposite, hooked portions at the front end thereof.

3. The battery terminal clamp of claim 1, wherein said elongated sliding slot can be a closed hole or an elongated hoe having an end communicating with said opening.

* * * * *